United States Patent [19]

Tamura et al.

[11] Patent Number: 4,693,962

[45] Date of Patent: Sep. 15, 1987

[54] PHOTOCHROMIC PHOTOSENSITIVE COMPOSITIONS

[75] Inventors: Shinichiro Tamura; Junetsu Seto, both of Kanagawa, Japan

[73] Assignee: Sony Corporation, Tokyo, Japan

[21] Appl. No.: 807,017

[22] Filed: Dec. 9, 1985

[30] Foreign Application Priority Data

Dec. 10, 1984 [JP] Japan ..... 59-260411

[51] Int. Cl.[4] ..... G03C 1/733

[52] U.S. Cl. ..... 430/345; 430/962

[58] Field of Search ..... 430/345, 962; 346/217, 346/218

[56] References Cited

U.S. PATENT DOCUMENTS

| | | | |
|---|---|---|---|
| 3,660,094 | 5/1972 | Poot | 430/345 |
| 4,372,582 | 2/1983 | Geisler | 346/218 |
| 4,485,168 | 11/1984 | Arakawa et al. | 430/345 |
| 4,565,779 | 1/1986 | Arakawa et al. | 430/962 |

*Primary Examiner*—Won H. Louie

*Attorney, Agent, or Firm*—Hill, Van Santen, Steadman & Simpson

[57] ABSTRACT

A photochromic photosensitive composition comprising a indolinobenzothipyran-based spiropyran compound, a transparent, high molecular weight film forming resin, and a compound represented by the general formula (I):

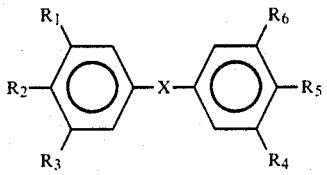

wherein $R_1$, $R_3$, $R_4$ and $R_6$ each represents a hydrogen atom, a halogen atom or a hydroxyl group, $R_2$ and $R_5$ each represents a hydrogen atom or a hydroxyl group, and X represents —NH—, —S—,

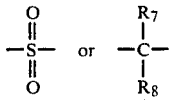

(where $R_7$ and $R_8$ each represents a hydrogen atom, $—CH_3$, $—C_2H_5$, $—CH_2CH_2COOH$ or

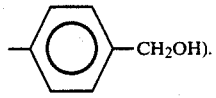

6 Claims, No Drawings

PHOTOCHROMIC PHOTOSENSITIVE COMPOSITIONS

BACKGROUND OF THE INVENTION

1. Field of the Invention

The present invention relates to photochromic photosensitive compositions and, more specifically, it relates to photochromic photosensitive compositions having additives containing at least two aromatic rings to improve the storage stability of the material in its colored state.

2. Description of the Prior Art

Compositions containing spiropyran compounds as photosensitive materials develop colors upon irradiation with ultraviolet rays to perform recording, and regain their initial colorless state upon heating or irradiation by visible rays. In the recording materials used in such a chemical process, measures have been taken for improving the heat stability of colored spiropyran compounds in order to preserve the recordings over a longer period of time.

For example, it has been suggested to add simple phenols to a composition containing a indolinobenzopyran-based spiropyran compound having a color developing wavelength at a shorter wavelength region (below 600 nm) as a photosensitive material, thereby improving the heat stability of the heat sensitive material in its colored state. There has further been proposed a indolinobenzothiopyran-based spiropyran compound which has superior heat stability properties in its colored state, to the indolinobenzopyran-based spiropyran compound described above, and which shows high absorption characteristics at or above the coloring wavelength of 700 nm, particularly, near 780 nm which is the oscillation wavelength region for a semiconductor laser.

However, there has been a problem in that the indolinobenzopyran-based spiropyran compound evidences a lowering of color density and the color wavelength band shifts toward the shorter wavelength side. In addition, the simple phenols bleed to the surface of the composition since they are less compatible with high molecular weight binders.

On the other hand, in the case of the indolinobenzothiopyran-based spiropyran compound, simple phenols are not as effective where it is intended to improve the stability of the compound in its colored state and preserve the recordings over a longer period of time.

SUMMARY OF THE INVENTION

In order to overcome the foregoing problems, the present invention provides photochromic photosensitive compositions comprising the combination of a indolinobenzothiopyran-based spiropyran compound, a high molecular weight, transparent film forming resinous binder, and a compound represented by the general formula (I):

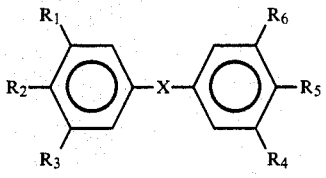

wherein $R_1$, $R_3$, $R_4$ and $R_6$ each represents a hydrogen atom, a halogen atom or a hydroxyl group, $R_2$ and $R_5$ each represents a hydrogen atom or a hydroxyl group, and X represents —NH—, —S—,

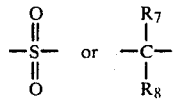

(where $R_7$ and $R_8$ each represents a hydrogen atom, $—CH_3$, $—C_2H_5$, $—CH_2CH_2COOH$ or

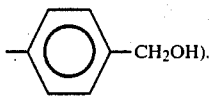

Compounds represented within the above-described general formula (I) which are preferably used in the composition according to this invention include the following compounds:

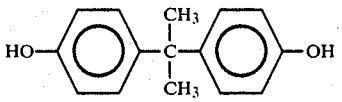

bisphenol A

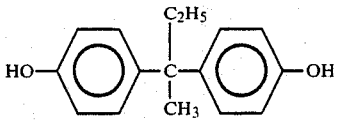

bisphenol B

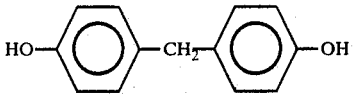

bis(p-hydroxyphenyl) methane

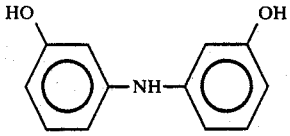

3,3'-dihydroxy-phenylamine

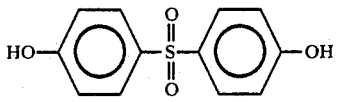

4,4'-bis(4-hydroxy-phenyl)sulfone

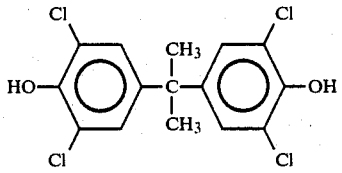

tetrachlorobis-phenol A

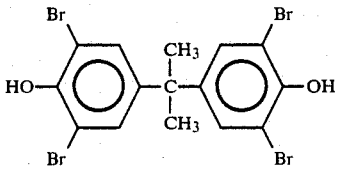

tetrabromobis-phenol A

-continued

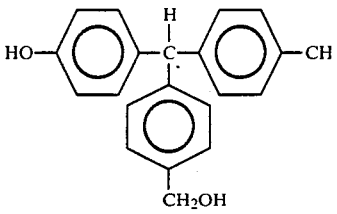

2-[bis(4-hydroxyphenyl)methyl]benzyl alcohol, and

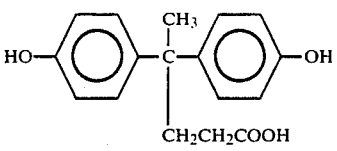

diphenolic acid

The indolinobenzothiopyran-based spiropyran compound preferably used in the composition according to the present invention includes compounds represented by the following three general formulae:

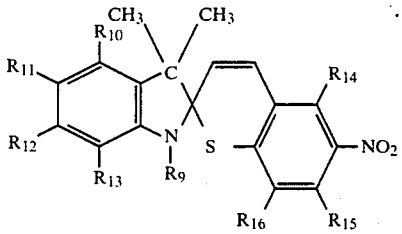

(II-1)

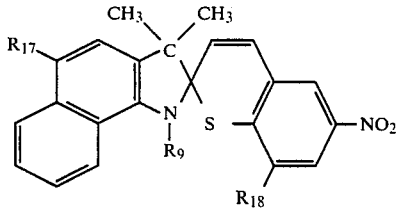

(III)

or

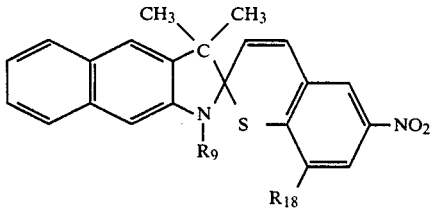

(IV)

wherein $R_9$ represents an alkyl group containing 1 to 20 carbon atoms, $R_{10}$, $R_{11}$, $R_{12}$, and $R_{13}$ each represents a hydrogen atom, an alkyl group containing 1 to 5 carbon atoms, an alkoxy group containing 1 to 5 carbon atoms, a halogen atom, a nitro group or dimethyl amino group, $R_{14}$, $R_{15}$ and $R_{16}$ each represents a hydrogen atom, an alkyl group containing 1 to 5 carbon atoms, an alkoxy group containing 1 to 5 carbon atoms or a halogen atom, $R_{17}$ and $R_{18}$ each represents a hydrogen atom, an alkyl group containing 1 to 5 carbon atoms, an alkoxy group containing 1 to 5 carbon atoms, an alkoxyalkyl group containing 2 to 10 carbon atoms, a halogen atom, a nitro group or a cyano group.

The preferred composition according to this invention uses the combination of a indolinobenzothiopyran-based spiropyran compound represented by the general formula (II-2):

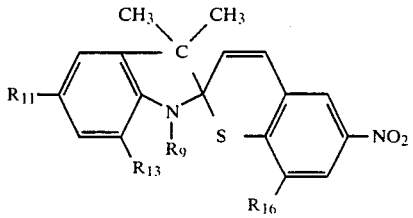

(II-2)

wherein $R_9$ represents an alkyl group containing 1 to 20 carbon atoms, $R_{11}$ and $R_{13}$ each represents a hydrogen atom or an alkyl group containing 1 to 5 carbon atoms, and $R_{16}$ represents a halogen atom or an alkyl group containing 1 to 5 carbon atoms, together with a tetrabromobisphenol A represented by the formula:

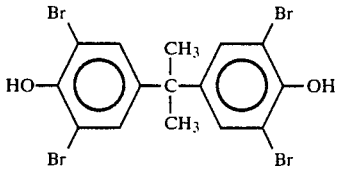

In the composition of the present invention, it is preferred to use from 10 to 60 parts by weight of the indolinobenzothiopyran-based spiropyran and from 10 to 60 parts by weight of the compound of the general formula (I) per 100 parts by weight of the high molecular weight binder for achieving the objects of this invention.

Any of the high molecular weight materials may be used in the composition of the present invention as long as they are compatible with the spiropyran compound described above, they are optically transparent, and have good film forming properties. Examples of such high molecular materials include polymethylmethacrylate, polystyrene, polyvinyl acetate, polyvinyl butyral, cellulose acetate, polyvinyl chloride, polyvinylidene chloride, vinylidene chloride-vinyl chloride copolymers, vinyl chloride-vinyl acetate copolymers, polypropylene, polyethylene, polyacrylonitrile, urethane resins, epoxy resins, phenoxy resins, and polyester resins.

The compositions according to the present invention may be used by dissolving them in an appropriate solvent and forming a film from the resulting solution or by coating the solution on an appropriate substrate and drying. They may also be used by kneading the compositions to dissolve them and then form a self-supporting film.

The support material may include materials such as polyethylene terephthalate, cellulose acetate, polycarbonate, ordinary paper, baryta paper, glass, metal, and the like.

DESCRIPTION OF THE PREFERRED EMBODIMENTS

The present invention will be described in more detail by reference to the following examples. In the examples, the storage stability in the colored state was tested by irradiating the photosensitive material with ultraviolet rays to develop color up to the saturation of absorption, and thereafter storing the material at 30° C. in the dark. Then, the storage stability was measured and indicated by the period of time required for the absorption coefficient at the maximum absorption wavelength to be reduced to ½ of its initial value.

EXAMPLE 1

Five parts by weight of 8-methoxy-6-nitro-1'-n-hexyl-3',3'-dimethyl-5'-methoxyspiro(2H-1-benzothiopyran-2,2'-indoline) represented by the following formula:

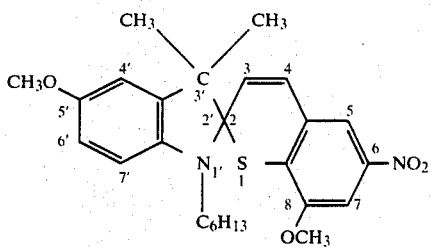

10 parts by weight of a vinylidene chloride-vinyl chloride copolymer, and 5 parts by weight of bisphenol A having the formula:

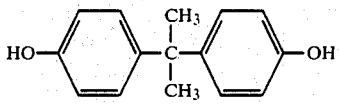

were dissolved in 150 parts by weight of cyclohexane. The solution was coated on an optically polished glass plate using a spinner. The coating was effected at 2700 rpm/min for two seconds. The wet coating was dried at a temperature of 80° C. under a reduced pressure for 2 hours to obtain a photosensitive sample.

EXAMPLES 2–9

Photosensitive samples were obtained in the same manner as in Example 1 but using the compounds shown in Table 1A in place of bisphenol A, as the compound having the general formula (I).

TABLE 1-A

| Ex. No. | Compounds used of the general formula (I) | | Storage stability (hr) |
|---|---|---|---|
| 1 | 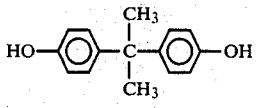 | bisphenol A | 75 |
| 2 | 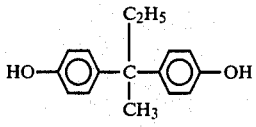 | bisphenol B | 120 |
| 3 | 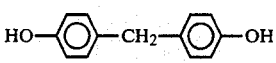 | bis(p-hydroxyphenyl)-methane | 250 |
| 4 | 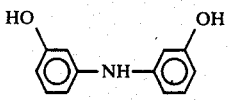 | 3,3'-dihydroxyphenylamine | 270 |
| 5 | 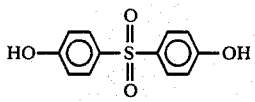 | 4,4'-bis(4-hydroxyphenyl) sulfone | 150 |

TABLE 1-A-continued

| Ex. No. | Compounds used of the general formula (I) | | Storage stability (hr) |
|---|---|---|---|
| 6 | 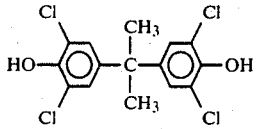 | tetrachlorobisphenol A | 130 |
| 7 | 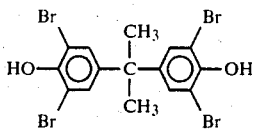 | tetrabromobisphenol A | 410 |
| 8 | 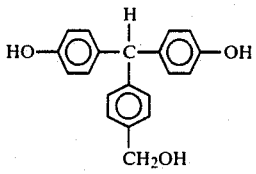 | 2-[bis(4-hydroxyphenyl) methyl]-benzyl alcohol | 230 |
| 9 | 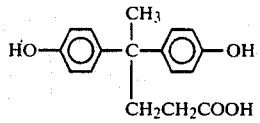 | diphenolic acid | 140 |

TABLE 1-B

| Comparative Example No. | Simple phenols | | Storage stability (hr) |
|---|---|---|---|
| 1 | 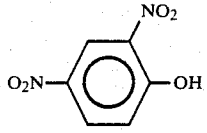 | 2,4-dinitrophenol | 40 |
| 2 | 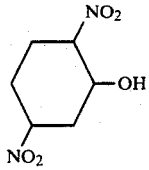 | 2,5-dinitrophenol | 50 |
| 3 | 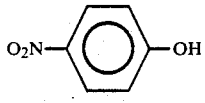 | p-nitrophenol | 50 |
| 4 | 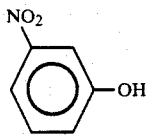 | m-nitrophenol | 50 |
| 5 | 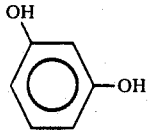 | resorcin | 40 |
| 6 | 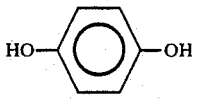 | hydroquinone | 40 |

TABLE 1-B-continued

| Comparative Example No. | Simple phenols | Storage stability (hr) |
|---|---|---|
| 7 | none | 38 |

COMPARATIVE EXAMPLES 1-7

In these Examples, the photosensitive samples were obtained in the same manner as in Example 1, but using the simple phenols shown in Table 1B in place of the bisphenol A used in Example 1.

The storage stability was measured as described above for each of the photosensitive samples obtained in Examples 1-9 and Comparative Examples 1-7, the results being shown in Tables 1A and 1B, respectively.

EXAMPLES 10-12

Three photosensitive samples were obtained in the same manner as in Example 1 using 5 parts of tetrabromobisphenol A, 10 parts by weight of the vinylidene chloride—vinyl chloride copolymer used in Example 7 and 5 parts by weight of each of the indolinobenzothiopyran-based spiropyran compounds illustrated in the following formulas (V)-(VII), respectively:

8-methoxy-6-nitro-1',3',3'-trimethylspiro(2H-1-benzothiopyran-2,2'-benz(f)indoline):

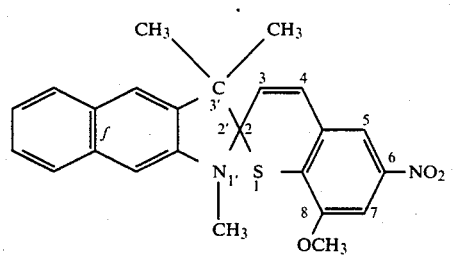

(V)

8-methoxy-6-nitro-5',7'-dimethoxy-3',3'-dimethyl-1'-n-hexylspiro(2H-1-benzothiopyran-2,2'-indoline):

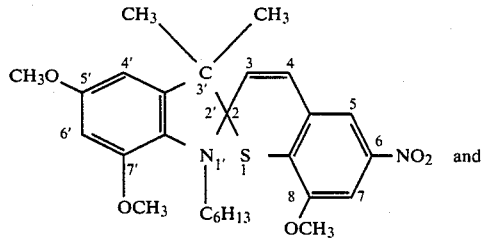

(VI) and 8-chloro-6-nitro-5'-methoxy-1',3',3'-trimethylspiro(2H-1-benzothiopyran-2,2'-indoline):

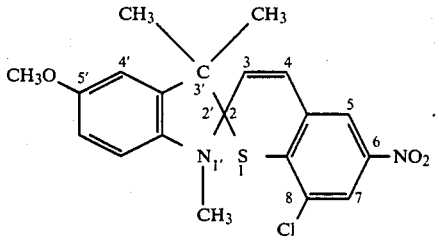

(VII)

The storage stability was measured as described above for each of the photosensitive samples obtained in the Examples 10-12. The results are shown in Table 2. For comparison, three other photosensitive samples were also prepared in the same manner as in Examples 10-12 except that tetrabromobisphenol A was not used, and they were measured for storage stability (Comparative Examples 8-10). The results are also shown in Table 2.

TABLE 2

| | | indolinobenzothiopyran-based spiropyran compound: formula number | addition of bisphenol A | storage stability (hr) |
|---|---|---|---|---|
| Example No. | 10 | V | yes | 140 |
| | 11 | VI | yes | 680 |
| | 12 | VII | yes | 1200 |
| Comparative Example No. | 8 | V | no | 30 |
| | 9 | VI | no | 240 |
| | 10 | VII | no | 480 |

As seen from the results described above, the photochromic photosensitive compositions containing the compounds represented by the general formula (I) are superior in storage stability in their colored state as compared with those containing only the simple phenols.

The reason that the compounds of the general formula (I) have the effect described above has not yet been completely determined. However, the fact that the simple phenols used in the Comparative Examples have pKa values in the range from 4.11 to 10.35 and provided no significant effect, suggests that the storage stability of the spiropyran compound of the general formula (II-1), (III) or (IV) in the colored state does not depend merely on the acid strength of the phenols. It may be possible that a steric effect between the spiropyran compound and the compound of the general formula (I), that is, a mutual positional relationship between the hydroxyl group in the compound of the general formula (I) and the —N+ and —S− groups formed by the coloring of the spiropyran compound also constitutes an important factor.

The storage stability of photochromic photosensitive compositions in their colored state can be improved by a factor of 10 or more times if the compound represented by the general formula (I) is incorporated into the mixture of a indolinobenzothiopyran-based spiropyran compound represented by the general formula (II-1), (III) or (IV) and a high molecular weight binder, as compared with the composition containing the same mixture with conventional simple phenols added thereto.

It will be evident that various modifications can be made to the described embodiments without departing from the scope of the present invention.

We claim as our invention:

1. A photochromic photosensitive composition comprising a photochromic spiropyran compound, a high molecular weight, optically transparent film forming a polymer, and a compound for stablizing said spiropyran compound in its colored state, said photochromic spirochromic compound being represented by one of the following general formulas:

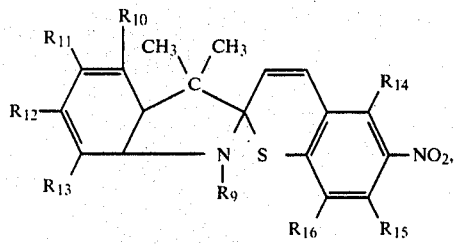

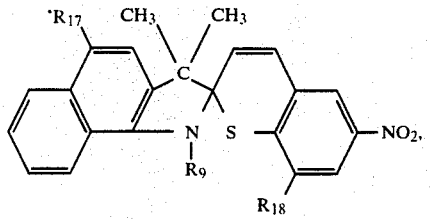

or

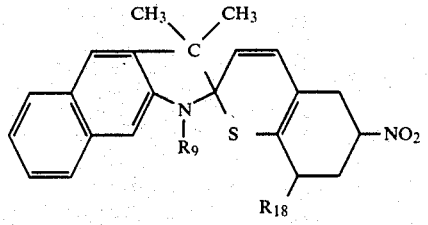

wherein $R_9$ represents an alkyl group containing 1 to 20 carbon atoms, $R_{10}$, $R_{11}$, $R_{12}$, and $R_{13}$ each represents a hydrogen atom, an alkyl group containing 1 to 5 carbon atoms, an alkoxy group containing 1 to 5 carbon atoms, a halogen atom, a nitro group or dimethyl amino group, $R_{14}$, $R_{15}$, and $R_{16}$ each represents a hydrogen atom, an alkyl group containing 1 to 5 carbon atoms or a halogen atom, $R_{17}$ and $R_{18}$ each repesents a hydrogen atom, an alkyl group containing 1 to 5 carbon atoms, an alkoxy group containing 1 to 5 carbon atoms, an alkoxyalkyl group containing 2 to 10 carbon atoms, a halogen atom, a nitro group or a cyano group, and said compound for stabilizing is selected from the group consisting of: 3,3'-dihydroxyphenyl amine and 4,4'-bis(4-hydroxyphenyl)sulfone.

2. A photosensitive composition according to claim 1 wherein said compound stabilizing is 3,3'-dihydroxyphenyl amine.

3. A photosensitive composition according to claim 1 wherein said compound for stabilizing is 4,4'-bis(4-hydroxyphenyl)sulfone.

4. A photochromic photosensitive composition comprising a photochromic spiropyran compound, a high molecular weight, optically transparent film forming polymer, and a compound for stabilizing said spiropyran compound in its colored state, said photochromic spiropyran compound being represented by the formula:

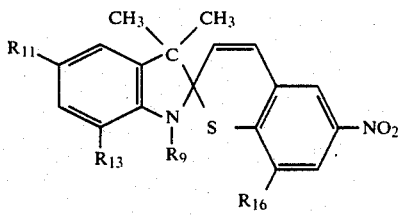

wherein $R_9$ represents an alkyl group containing 1 to 20 carbon atoms, $R_{11}$ and $R_{13}$ each represents a hydrogen atom or an alkyl group containing 1 to 5 carbon atoms or an alkoxy group containing 1 to 5 carbon atoms, said compound for stabilizing being selected from the group consisting of 3,3'-dihydroxxyphenyl amine and 4,4' bis(4-hydroxy-phenyl)sulfone.

5. A photosensitive composition according to claim 4 wherein the compound for stabilizing is 3,3'-dihydroxyphenyl amine.

6. A photosensitive composition according to claim 4 wherein the compound for stabilizing is 4,4' bis(4-hydroxyphenyl)sulfone.

* * * * *